US012788206B2

(12) United States Patent
Disch et al.

(10) Patent No.: US 12,788,206 B2
(45) Date of Patent: Nov. 10, 2026

(54) DISHWASHER FOR A COFFEE SHOP AND/OR A FAST-FOOD RESTAURANT

(71) Applicant: ILLINOIS TOOL WORKS INC., Glenview, IL (US)

(72) Inventors: Harald Disch, Elzach (DE); Martin Schrempp, Biberach (DE)

(73) Assignee: ILLINOIS TOOL WORKS INC., Glenview, IL (US)

( * ) Notice: Subject to any disclaimer, the term of this patent is extended or adjusted under 35 U.S.C. 154(b) by 177 days.

(21) Appl. No.: 18/687,371

(22) PCT Filed: Aug. 19, 2022

(86) PCT No.: PCT/US2022/040843

§ 371 (c)(1),
(2) Date: Feb. 28, 2024

(87) PCT Pub. No.: WO2023/034041

PCT Pub. Date: Mar. 9, 2023

(65) Prior Publication Data

US 2024/0349974 A1 Oct. 24, 2024

(30) Foreign Application Priority Data

Sep. 1, 2021 (DE) ..... 10 2021 122 656.2
May 19, 2022 (DE) ..... 10 2022 112 613.7

(51) Int. Cl.
*A47L 15/24* (2006.01)
*A47L 15/00* (2006.01)
*A47L 15/42* (2006.01)

(52) U.S. Cl.
CPC ..... *A47L 15/245* (2013.01); *A47L 15/0021* (2013.01); *A47L 15/0071* (2013.01);
(Continued)

(58) Field of Classification Search
CPC ..... A47L 15/245; A47L 15/0071
See application file for complete search history.

(56) References Cited

U.S. PATENT DOCUMENTS

2021/0259509 A1 8/2021 Sperry

FOREIGN PATENT DOCUMENTS

CN 109394119 A 3/2019
CN 113208528 A * 8/2021 ..... A47L 15/42
(Continued)

OTHER PUBLICATIONS

International Searching Authority, Search Report and Written Opinion issued in corresponding Application No. PCT/US2022/040843 mailed Dec. 7, 2022, 12 pages.

*Primary Examiner* — Spencer E. Bell
(74) *Attorney, Agent, or Firm* — THOMPSON HINE LLP

(57) ABSTRACT

A dishwasher (1), in particular for a coffee shop and/or for a fast-food restaurant, for cleaning washware, in particular and preferably exclusively washware provided by the coffee shop and/or fast-food restaurant, wherein the dishwasher (1) is associated with an input or insertion region (2) adapted in particular as a return device and in particular adapted as a return machine for reusable washware items (100), and a transport device (3) for transporting the washware from the input or insertion region (2) to a treatment region (4) of the dishwasher (1) and from there to an output or removal region (10) of the dishwasher (1), the treatment region (4) of the dishwasher (1) having a washing and rinsing system (5) for washing and rinsing the washware and optionally, a drying system (6) for drying the rinsed washware, the drying system located downstream when viewed in the transport direction of the washware.

22 Claims, 12 Drawing Sheets

(52) U.S. Cl.
CPC ..... *A47L 15/247* (2013.01); *A47L 15/4259* (2013.01); *A47L 2401/04* (2013.01); *A47L 2501/22* (2013.01); *A47L 2501/30* (2013.01)

(56) References Cited

FOREIGN PATENT DOCUMENTS

| | | | |
|---|---|---|---|
| DE | 102013226080 | A1 | 6/2015 |
| EP | 3015043 | A1 | 5/2016 |
| WO | WO-2020186344 | A1 | 9/2020 |
| WO | WO-2021011604 | A1 | 1/2021 |

* cited by examiner

DISHWASHER FOR A COFFEE SHOP AND/OR A FAST-FOOD RESTAURANT

TECHNICAL FIELD

The present invention relates generally to the field of commercial dishwashing and specifically to a dishwasher for a coffee shop and/or for a fast-food restaurant for cleaning washware.

BACKGROUND

The dishwasher according to the invention is designed as a conveyor dishwasher and comprises a transport device for transporting washware from an input or insertion region associated with the dishwasher to a treatment area of the dishwasher and from there to an output or removal region of the dishwasher. The input or insertion region associated with the dishwasher represents the dirty zone, while the output or removal region of the dishwasher represents the clean zone of the machine.

Conveyor dishwashers of this type are used in the commercial sector. Unlike domestic dishwashers, wherein the washware to be cleaned remains stationary in the dishwasher during cleaning, these conveyor dishwashers transport the washware through different treatment zones of the machine.

In contrast to the batch processes of stationary programmed machines, such as domestic dishwashers or undercounter dishwashers, continuous operation is possible because conveyor dishwashers transport the washware through different treatment zones (in particular wash zones and rinse zones) of the machine. The disadvantage of conveyor dishwashers, however, is the relatively large footprint requirement in the installation room.

Nevertheless, there is an increasing need to utilize the advantages of a conveyor dishwasher in applications that only provide limited installation floorspace.

Nowadays hot beverage vending machines, in particular coffee machines, of various models and sizes are almost always available for self-service in hotels, company cafeterias, public buildings, hospitals, schools and highway rest areas. These hot beverage vending machines are typically adapted to fill drinkware (beverage cups) with a selected hot beverage; however, plastic cups are also used by vending machines installed in businesses or public buildings.

This applies likewise in coffee shops or fast-food restaurants, where it is common practice to serve a coffee specialty selected by the customer to the customer in a so-called coffee-to-go cup. Given the enormous amount of plastic waste generated every day by disposable tableware, there is an effort to reduce the amount of disposable tableware used, in particular in coffee shops or fast-food restaurants.

One approach to reducing the ecological footprint of coffee shops or fast-food restaurants is to use disposable tableware, such as disposable coffee-to-go cups, that are recyclable. In this context, disposable tableware made of cellulose acetate or so-called oxo-biodegradable plastics, for example, are known.

The problem with such disposable tableware, however, is that the oxo-biodegradable plastics can degrade only under specific defined conditions, whereby these specific conditions are generally not in place for recycling. As a result, the material of the disposable tableware breaks down into microplastics and can continue to burden health and the environment.

Moreover, the production of disposable tableware made of oxo-biodegradable plastic is relatively complex and therefore likewise has a negative impact on the ecological footprint.

Given this problem definition, the task is therefore based on providing a solution, in particular for coffee shops or fast-food restaurants, that can significantly reduce their ecological footprint.

SUMMARY

In order to solve the above-mentioned problem, a dishwasher according to independent claim 1 is proposed, wherein advantageous dependent embodiments of the inventive dishwasher are described in the dependent claims.

The invention accordingly concerns a dishwasher, in particular for a coffee shop and/or for a fast-food restaurant, for cleaning washware, in particular and preferably exclusively washware served by the coffee shop and/or fast-food restaurant, wherein the dishwasher is associated with an input or insertion region adapted in particular as a return device and preferably in particular as a return machine for reusable washware items, and wherein the dishwasher comprises a transport device for transporting the washware from the input or insertion region to a treatment region of the dishwasher and from there to an output or removal region of the dishwasher, wherein the treatment region of the dishwasher comprises a washing and rinsing system for washing and rinsing the washware and, if necessary, a drying system for drying the rinsed washware, said drying system being located downstream when viewed in the transport direction of the washware.

The input or insertion region associated with the dishwasher, and in particular adapted as a return device, and preferably in particular adapted as a return machine for reusable, washware items, need not be part of the dishwasher itself. This can in particular be a return station arranged remotely from the actual dishwasher that is ultimately connected to the dishwasher with the transport device in order to feed the washware deposited by a customer at the input or insertion region in particular to the treatment area of the dishwasher.

For example, it may be provided that the input or insertion region associated with the dishwasher, in particular as a return device, and preferably in particular as a return machine for reusable washware items, is arranged separately from the treatment area of the dishwasher, and in particular from an inlet tunnel of the dishwasher leading to the treatment area of the dishwasher.

Preferably, the input or insertion region associated with the dishwasher, and in particular adapted as a return device, preferably in particular adapted as a return machine for reusable, washware items, comprises a refund device.

Alternatively or additionally, it is conceivable that the input or insertion region associated with the dishwasher and in particular adapted as a return device and preferably in particular adapted as a return machine for reusable washware items, comprises a user interface and an identification device for washware items that cooperates with a data processing device and a data storage device, wherein the identification device in particular comprises an optical detection system and/or wherein the identification device is adapted for barcode recognition, RFID detection, three-dimensional surface analysis, 3D-Matching, logo recognition, OCR detection and/or color detection.

According to realizations of the invention, it is provided that the input or insertion region associated with the dishwasher and in particular adapted as a return device and preferably in particular adapted as a return machine for reusable washware items has at least one access opening for receiving washware items, wherein the access opening is associated with a closing element adjustable between an open position and a closed position.

In this context in particular, it is possible that the input or insertion region associated with the dishwasher and in particular adapted as a return device and preferably in particular adapted as a return machine for reusable washware items, has at least one access opening with an outline corresponding to the washware item to be cleaned to specify an orientation of the washware item when manually placing the washware item in the input or insertion region.

According to realizations of the dishwasher according to the invention, it is provided that the dishwasher, and in particular the input or insertion region associated with the dishwasher, and in particular adapted as a return device, and in particular preferably adapted as a return machine for reusable washware items, comprises a device for sorting the washware items according to their size and/or type, wherein the washware items, sorted by size and/or type, are in particular automatically fed to a corresponding transport lane of the transport device.

The transport device of the dishwasher according to the invention preferably comprises at least two transport lanes that run in parallel and are adapted to simultaneously and in parallel transport at least two washware items through the dishwasher, wherein preferably at least one of the at least two transport lanes and in particular each of the at least two transport lanes is in particular adapted to only accept washware items of a size and/or type respectively assigned to the respective transport lane.

According to embodiments of the inventive dishwasher, it is provided that a stacking device is provided in the transport direction of the washware when viewed in downstream direction of the drying system in the output or removal region of the dishwasher for automatically stacking the washware items dried in the drying system.

The stacking device may be adapted to stack the washware items dried in the drying system—in particular by size and/or type of washware items—in a corresponding washware stack.

The dishwasher preferably has a length of about 1 to 3 meters, a height of about 1 to 1.75 meters and a width of about 0.3 to 1 meter.

Preferably, the input or insertion region associated with the dishwasher is embodied as a washware return system, similar to an empty container return system, and forms the user interface with the customer of the coffee shop or fast-food restaurant. For this purpose, the input or insertion region of the dishwasher comprises at least one access opening for receiving washware items, wherein the access opening is associated with a closing element adjustable between an open position and a closed position.

The customer of the coffee shop or fast-food restaurant places the washware item to be cleaned at the access opening of the input or insertion region of the dishwasher.

The user interface of the dishwasher at the input or insertion region preferably comprises an identification device having a data processing device and a data storage device, the identification device being adapted to identify the washware item placed by the customer at the at least one access opening at the input or insertion region of the dishwasher.

For example, the identification device may comprise an optical detection system. Alternatively or additionally, the identification device may be adapted for barcode recognition, RFID recognition, three-dimensional surface analysis, 3D-Matching, logo recognition, OCR recognition, and/or color recognition. A customer of the coffee shop or fast-food restaurant can place a washware item to be returned, for example a beverage cup, at the at least one access opening into the input or insertion region of the dishwasher. The identification device is used to identify what washware item, for example what type of washware item (beverage cup, plates, etc.), is involved. Preferably, the identification device or the data processing device associated with the identification device is further adapted to identify whether the washware item is a washware item served or accepted by the coffee shop operator or the fast-food restaurant operator.

If the washware item is identified as a washware item stored in the data storage device and accepted by the operator of the dishwasher, for example the coffee shop operator or the fast-food restaurant operator, an amount to be refunded for this item can be displayed on a display of the user interface. Said amount can for example be paid out in the form of a cash disbursement. However, it is also possible that the person is granted a credit, wherein the purchase price of a new beverage or food item is reduced by the amount refunded for the returned washware item. The person can then decide if they would like to have the appropriate amount paid out or wish to buy a new food item/merchandise at a reduced price.

An option is also conceivable according to which the person rejects the amount to be refunded and removes the washware item from the input or insertion region of the dishwasher. Likewise, the person may be prompted to remove the washware item from the input or insertion region of the dishwasher if the placed washware item could not be identified.

Accordingly, the input or insertion region associated with the dishwasher is adapted as a return machine for reusable washware items and preferably has a refund device.

With regard to the refund device, it is generally conceivable that the person will be issued a paper slip or paper ticket as is known on empty container machines.

However, a paperless and customer-simplified refund slip preparation method is preferred. A paperless method could be to transmit such a refund slip to a smartphone. Transmission to the smartphone may be accomplished by wireless devices. One of these works, for example, by means of NFC (Near Field Communication). Since most smartphones and many credit cards support this transmission standard, it is also preferable to pay for further merchandise/food items in the coffee shop/fast-food restaurant at a later date using this transmission standard.

Preferably, the input or insertion region, in particular adapted as a return machine, is separated from the washing and rinsing system as well as the downstream drying system of the dishwasher such that only the input or insertion region, embodied as a return machine, is visible to the customer.

In this context, it is in particular suitable for the input or insertion region of the dishwasher to have at least one access opening for receiving washware items, wherein the access opening is associated with a closing element that is adjustable between an open position and a closed position. The closing element associated with the at least one access opening preferably opens automatically after actuation of a corresponding switch in the user interface of the input or insertion region of the dishwasher. It is also conceivable to manipulate the closing element by means of a proximity sensor.

The input or insertion region of the dishwasher associated with the dishwasher is connected to the dishwasher and the treatment zones of the dishwasher by the transport device such that the washware item placed by the customer at the input or insertion region can be fed to the washing and rinsing system and subsequently to the drying system. It is preferred that the treatment zones of the dishwasher are not visibly arranged for the customer, for example behind a corresponding building partition or the like.

In this way, the dishwasher can be integrated in the coffee shop or fast-food restaurant in a particularly harmonious manner.

If the customer placed the washware item at the input or insertion region of the dishwasher adapted as the return machine, and if the optionally provided identification device accepted the placed washware item, the latter is then transported into the treatment zones of the dishwasher with the aid of the transport device, where a wash cycle, then a rinse cycle, if necessary a disinfection cycle and then a drying cycle take place. With the aid of a stacking device, the cleaned washware item is then automatically stacked at the (clean side) output or removal region of the dishwasher.

According to preferred implementations of the inventive dishwasher, the input or insertion region of the dishwasher comprises at least one access opening with an outline corresponding to the washware item to be cleaned, in order to specify an orientation of the washware item when manually placing the washware item into the input or insertion region.

This is a particularly easy to implement method that is also easy to understand for the customer, particularly based on the Poka-Yoke principle, to indicate to the customer in which orientation the washware item is to be placed. Preferably, the washware item should be introduced into the input or insertion region in an upside-down orientation.

Alternatively or in addition to the aforementioned adaptation, the dishwasher preferably comprises, at the input or insertion region, a device for sorting the washware items according to their size and/or type, wherein the washware items, sorted by size and/or type, are preferably automatically fed to a corresponding transport lane of the transporting device.

The device for sorting the washware items according to their size and/or type can have an outline corresponding to the washware item to be cleaned. In particular, it can be provided in this respect that a plurality of different access openings with different outlines are provided in the input or insertion region of the dishwasher, which only allow placement of a washware item corresponding to the respective outline.

The transport device of the dishwasher should have at least two transport lanes running in parallel in order to achieve the most efficient washing and rinsing result. The at least two transport lanes running in parallel are in particular adapted to simultaneously and in parallel transport at least two washware items through the dishwasher. In this context in particular, it is provided that each of the at least two transport lanes are adapted to in particular exclusively accept washware items of a pre-determined size and/or type and assigned to the respective transport lane.

In this context, it is in particular expedient that the stacking device is adapted at the output or removal region of the dishwasher to stack washware items dried in the drying system of the dishwasher into a corresponding stack of washware items—in particular by the size and/or type of washware items.

According to preferred implementations of the inventive dishwasher, the dishwasher comprises a device for automatically determining the cleanliness of the washware cleaned by the washing and rinsing system. This measure ensures that only sufficiently cleaned washware items are output at the output or removal region of the dishwasher, which can then be reused by the coffee shop operator or the fast-food restaurant operator for serving foods.

The means for determining the cleanliness of the washware cleaned in the washing and rinsing system preferably operates automatically to facilitate an objective assessment. For example, a camera can be used to capture a digital image of the washware item to be inspected. Further, the device may comprise a controller for processing the captured digital image.

The means for automatically determining the cleanliness of the washware cleaned in the washing and rinsing system is preferably tailored specifically to the washware to be inspected, which may include providing suitable lighting, camera settings, and camera position relative to the washware item being washed. In this way, the inspection system may generate a brightness value according to controlled environmental settings.

In accordance with further embodiments of the lastly mentioned aspect, it can be provided that a washware item is automatically recycled to the wash and rinse system if the cleanliness value does not correspond to a pre-determined threshold value. Alternatively, it is conceivable to place a washware item identified as being insufficiently clean in a pre-determined area of the output or removal region of the dishwasher.

The input or insertion region associated with the dishwasher or an area of the dishwasher upstream of the treatment area of the dishwasher may be adapted as a storage area for temporarily storing a pre-determined or specifiable number of washware items to be cleaned.

The same applies alternatively or in addition to this for the output or removal region of the dishwasher.

In this context, it is conceivable that the dishwasher comprises a control device adapted to control the transport device such that the transport device transports the washware to be cleaned discontinuously, e.g., in a chronologically interrupted manner, from the input or insertion region of the dishwasher through the washing and rinsing system and drying system to the output or removal region of the dishwasher, preferably also at different speeds.

Alternatively, however, it is of also conceivable for the dishwasher to comprise a control adapted to control the at least one transport device such that the at least one transport device transports the washware to be cleaned continuously through the washing and rinsing system, and in particular at a pre-determined or specifiable transport speed, through the at least one treatment zone.

The dishwasher may further comprise a control device for controlling the transport device and/or controllable components associated with the washing and rinsing system and/or the drying system. It is expedient that the transport device and, if necessary, the controllable components associated with the washing and rinsing system and/or the drying system can be controlled as a function of a presence or absence, or as a function of a number of washware items in the input or insertion region and/or the output or removal region of the dishwasher.

Preferably, the washing and rinsing system as well as the drying system and in particular also the output or removal region of the dishwasher are centrally accommodated in a dishwashing area, whereby the input or insertion region of the dishwasher adapted as a return machine is arranged spatially separated therefrom.

Embodiments of the inventive dishwasher provide that the input or insertion region of the dishwasher, associated with the dishwasher and in particular adapted as a return device and preferably in particular adapted as a return machine for reusable washware items, comprises a first access opening for accepting washware items of a first type and/or a first size and/or a first shape and at least a second access opening for accepting washware items of a second type and/or a second size and/or a second shape. Each access opening is preferably associated with its own transport lane adapted to transport the washware item placed at the corresponding access opening through the dishwasher.

Alternatively, or in addition to this embodiment, it is conceivable that the input or insertion region associated with the dishwasher and in particular adapted as a return device and preferably in particular adapted as a return machine for reusable washware items has a first access opening to accept beverage cups of a first size, a second access opening for accepting beverage cups of a second size, and a third access opening for accepting beverage cups of a third size. Here, too, each access opening is preferably associated with its own transport lane adapted to transport the washware item placed at the corresponding access opening through the conveyor dishwasher.

In this context, it is generally conceivable that each access opening is associated with its own closing element (door) adjustable between an open position and a closed position.

Further, it is conceivable in this context that the dishwasher comprises a washware detection system adapted to detect the type, size and/or shape of a washware item to be placed into the dishwasher, wherein the dishwasher is preferably adapted to control a closing element of one of the access openings depending on the type, size and/or shape of the washware item such that it transitions from its closed position to its open position and allows the washware item to be assigned to the corresponding access opening.

In particular, the dishwasher may have an interface, which can preferably be used to manually select and/or enter the type, size and/or shape of a washware item to be fed into the dishwasher, wherein the dishwasher may be adapted in this case to control a closing element of one of the access openings depending on the type, size and/or shape of the washware item such that it transitions from its closed position to its open position and allows the washware item to be assigned to the corresponding access opening. Of course, these considerations are also applicable to dishwashers where only a single access opening is provided.

The dishwasher preferably comprises a load detection adapted to detect that a washware item was placed in the (only) or in any of the access openings. In this context, the load detection can be further adapted to control the closing element associated with the respective access opening when or after detecting that a washware item was placed in any of the access openings such that it transitions from its open position to its closed position.

The transport device of the inventive dishwasher comprises at least one transport lane and preferably a plurality of transport lanes that run in parallel. The at least one transport lane can have adjacent, dedicated acceptance areas, wherein each acceptance area is preferably adapted to accept and releasably secure precisely one washware item. In this context, it is conceivable, for example, that a hold-down device is associated with the at least one transport lane, the hold-down device being adapted to secure the washware item accepted by the receiving area in particular in vertical direction.

A conceivable realization of the last-mentioned embodiment provides that the hold-down device associated with the at least one transport lane comprises at least one guide that preferably travels together with the transport lane and extends laterally and/or above the washware item accepted by the receiving area.

Embodiments of the inventive dishwasher provide that the at least one transport lane per receiving area comprises at least one finger area projecting perpendicularly or transversely to the transport direction of the transport lane, and is adapted to at least sectionally accept a washware item.

The inventive solution even gives a coffee shop or fast-food restaurant economic advantages by switching from disposable tableware to reusable tableware, since no logistics are to be provided in particular in the form of workers to collect the soiled tableware.

BRIEF DESCRIPTION OF THE DRAWINGS

Exemplary embodiments of the inventive dishwasher are described in more detail below with reference to the accompanying drawings.

DETAILED DESCRIPTION

Figure 1:
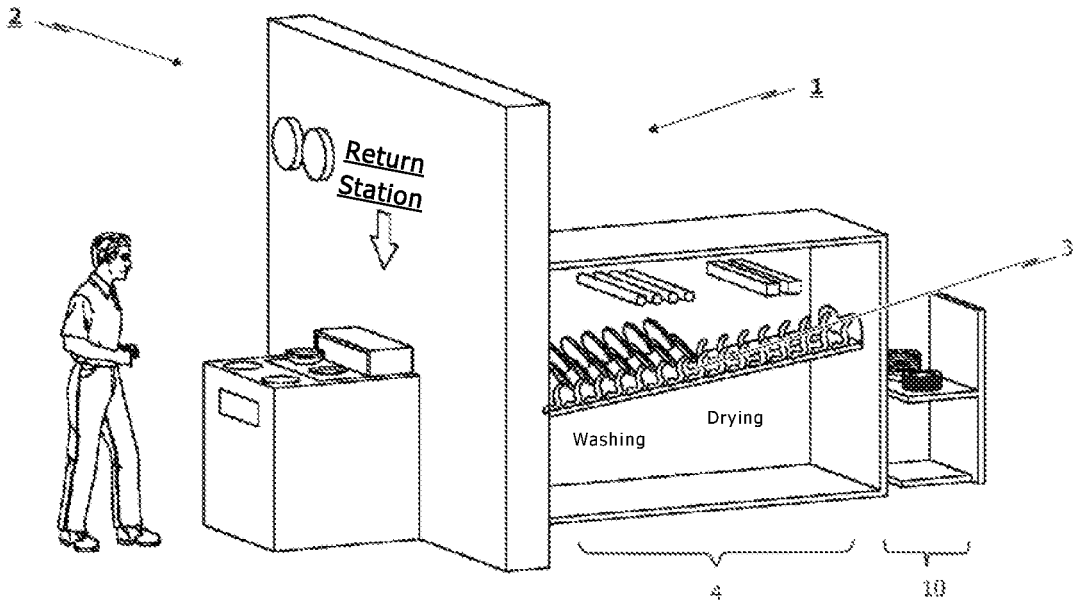
FIG. 1 a principle rendering of an exemplary embodiment of the inventive dishwasher in a schematic isometric side view.

The exemplary embodiments of the inventive dishwasher 1 are in particular suitable for coffee shops or fast-food restaurants where reusable tableware is used that is returned by the customer.

According to the exemplary embodiment shown in the drawings, the dishwasher 1 for this purpose comprises an input or insertion region 2, which is embodied as a return machine for reusable, washware items 100.

The return machine is installed accessible for the customer of the coffee shop or fast-food restaurant. It may include a user interface and an identification device for washware items 100 that cooperates with a data processing device and a data storage device to identify the washware item 100 returned by the customer.

The input or insertion region 2 of the dishwasher 1 comprises at least one access opening, wherein the access opening is associated with a closing element adjustable between an open position and a closed position.

From the input or insertion region 2 of the dishwasher 1, the placed and preferably accordingly identified washware item 100 is transported to the treatment area 4 of the dishwasher 1 with the aid of a transport device 3. This is in particular a treatment zone with a washing and rinsing system 5 as well as a downstream drying zone 6—when viewed in the transport direction of the washware.

Preferably, the input or insertion region 2 of the dishwasher 1 has at least one access opening with an outline corresponding to the washware item 100 to be cleaned to specify an orientation of the washware item 100 when manually placing the washware items 100 into the input or insertion region 2.

Alternatively or additionally, the dishwasher 1 preferably comprises, at the input or insertion region 2 or upstream of the treatment area 4, a device for sorting the washware items 100 according to their size and/or type, wherein the washware items 100, sorted by size and/or type, are then fed to the respective treatment zones. In particular, the washware items 100, sorted by size and/or type, are preferably automatically fed to a corresponding transport lane of the transport device 3.

The transport device 3 comprises at least two transport lanes running in parallel, which are adapted to simultaneously and in parallel transport at least two washware items 100 through the dishwasher 1. Preferably, at least one of the at least two transport lanes is adapted, and in particular each of the at least two transport lanes are adapted to in particular exclusively accept washware items 100 of a size and/or type assigned to the respective transport lane.

A stacking device 8 at the output or removal region of the dishwasher 1 is adapted to stack the items 100 dried in the drying system, in particular by size and/or type of washware items 100, into a corresponding stack of washware items. Alternatively, however, it is also conceivable that the cleaned and dried washware items 100 are output into a container or the like provided at the output or removal region of the dishwasher 1, i.e., without forming a stack.

Figure 2:
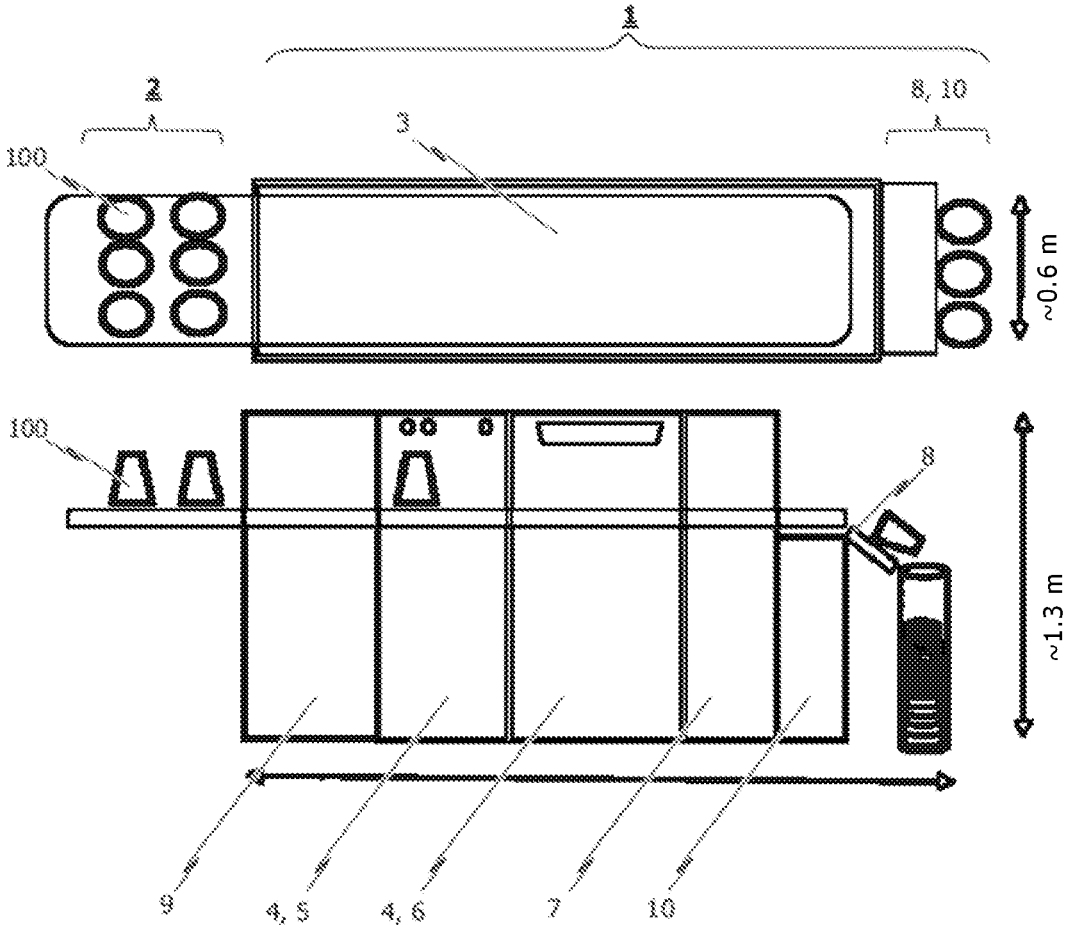
FIG. 2 an exemplary embodiment of the inventive dishwasher in a schematic top view and side view.

The embodiment of the inventive dishwasher 1 shown schematically in FIG. 2 comprises a storage area 9 in which the placed washware items 100 can be pre-sorted and temporarily stored.

Furthermore, the dishwasher 1 shown schematically in FIG. 2 comprises a device 7 for automatically determining the cleanliness of the washware item 100 cleaned in the washing and rinsing system 5.

In FIG. 2, it is further indicated that the treatment area of the dishwasher 1, e.g., the area of the dishwasher 1 connected by the transport device 3 to the input or insertion region 2 of the dishwasher 1 and adapted as a return machine, has a length of about 2.5 m at a height of about 1.3 m and a width of about 0.6 m.

Figure 3:
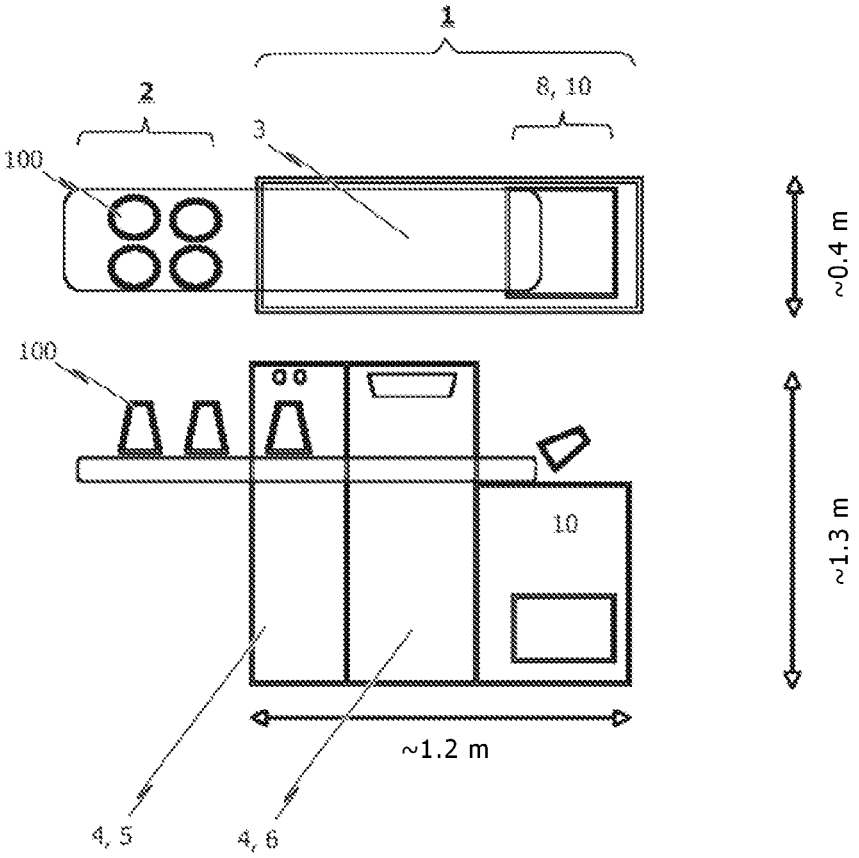
FIG. 3 a further exemplary embodiment of the inventive dishwasher in a schematic top view and side view.
Figure 4:
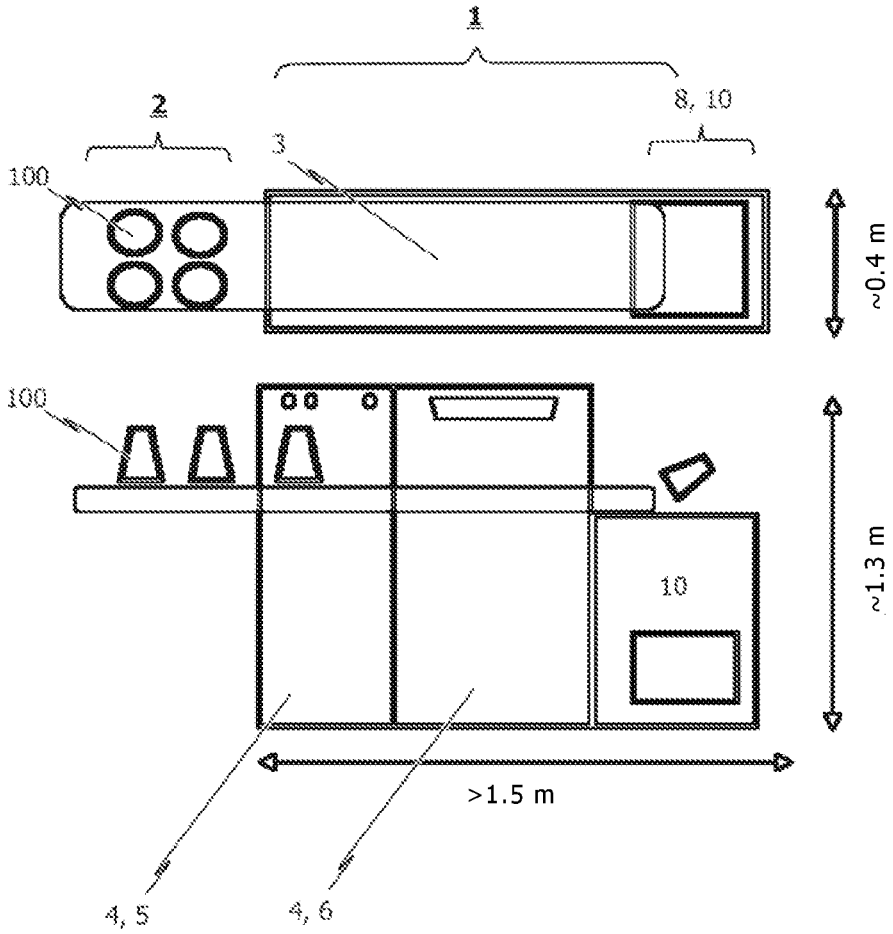
FIG. 4 a further exemplary embodiment of the inventive dishwasher in a schematic top view and cross-section side view.
Figure 5:
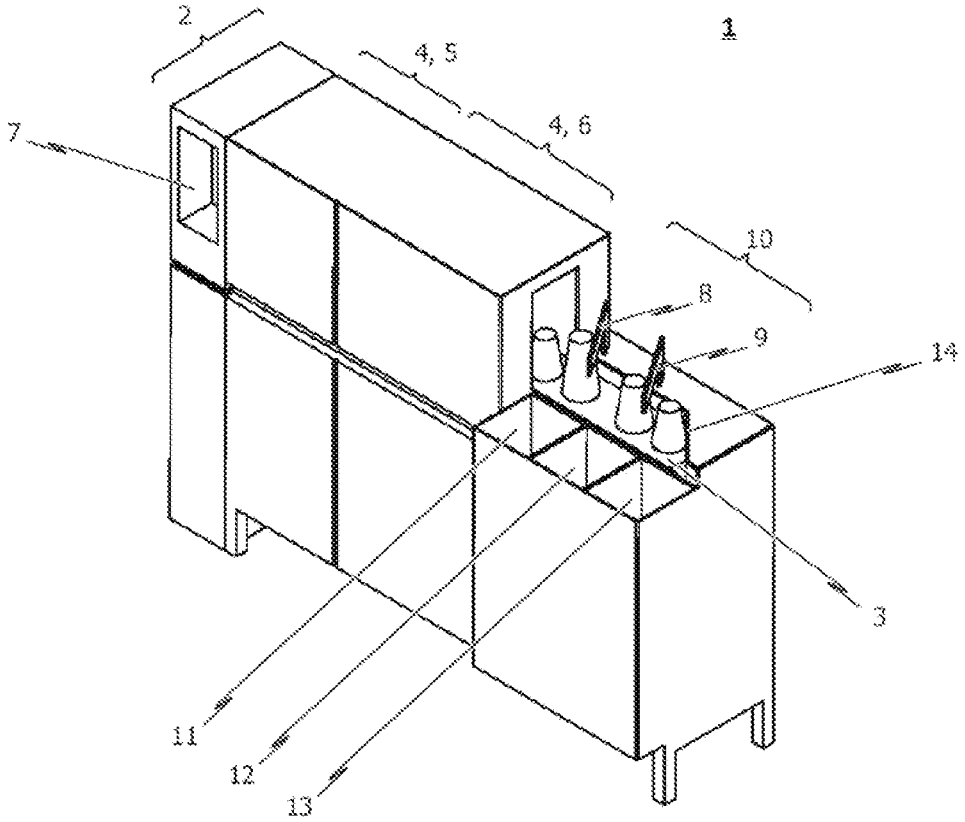
FIG. 5 a further embodiment of the inventive dishwasher in a schematic isometric side view.
Figure 6:
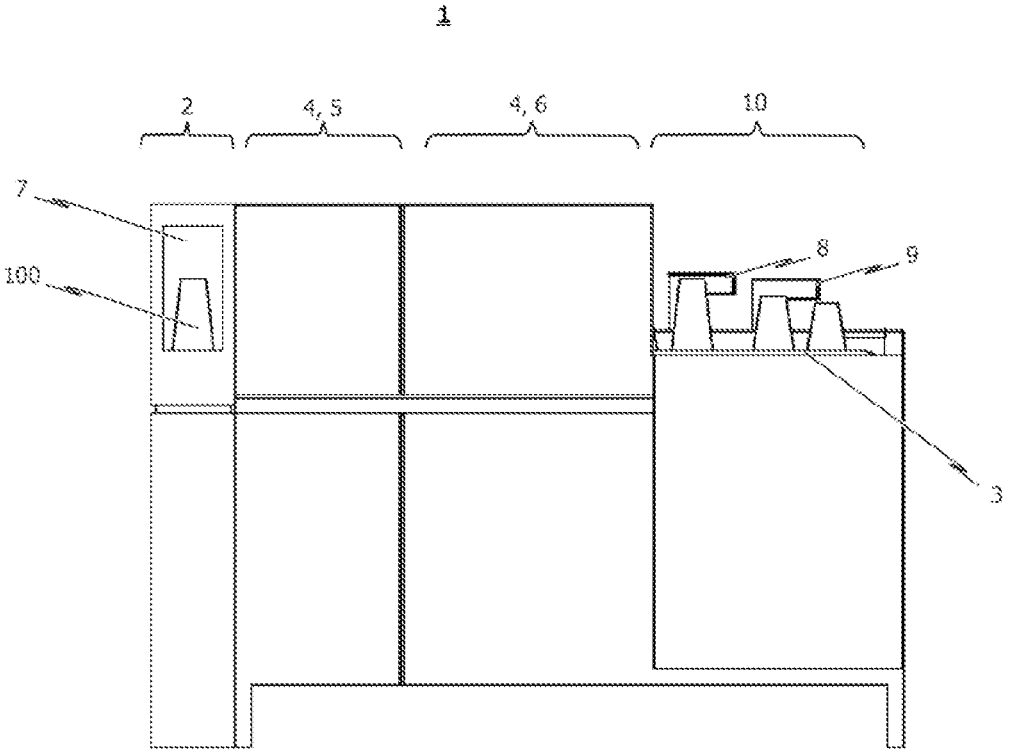
FIG. 6 the embodiment of the inventive dishwasher according to FIG. 5 in a schematic side view.
Figure 7:
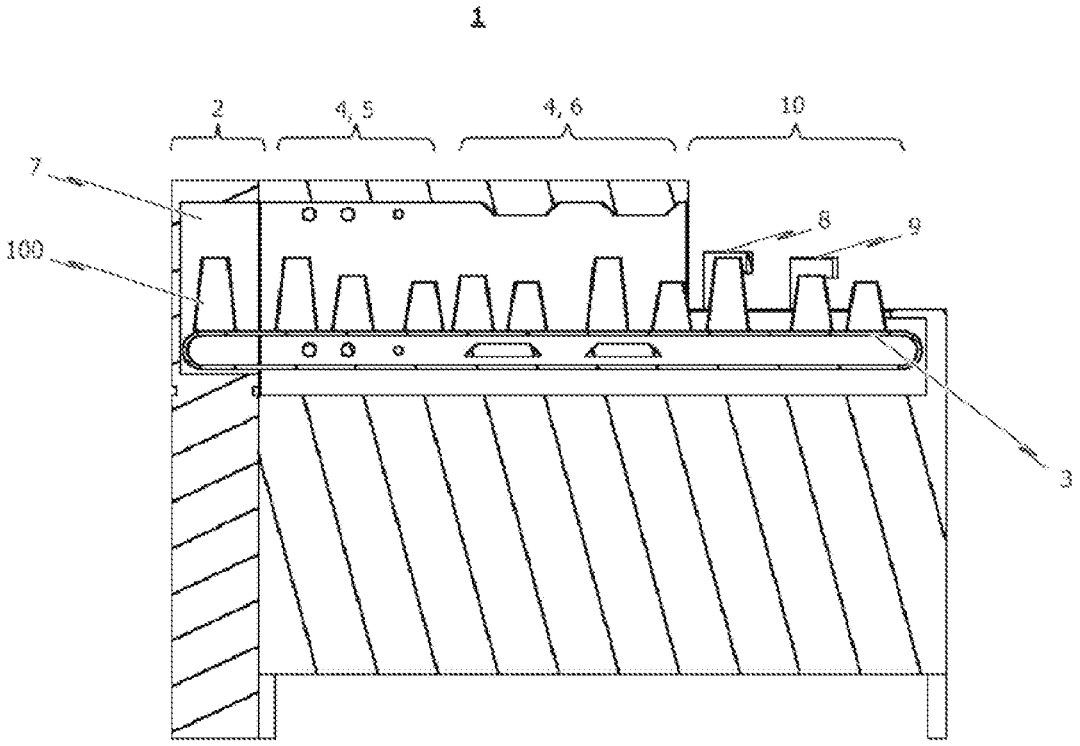
FIG. 7 the embodiment of the inventive dishwasher according to FIG. 5 in a schematic, partially cross-sectional side view.
Figure 8:
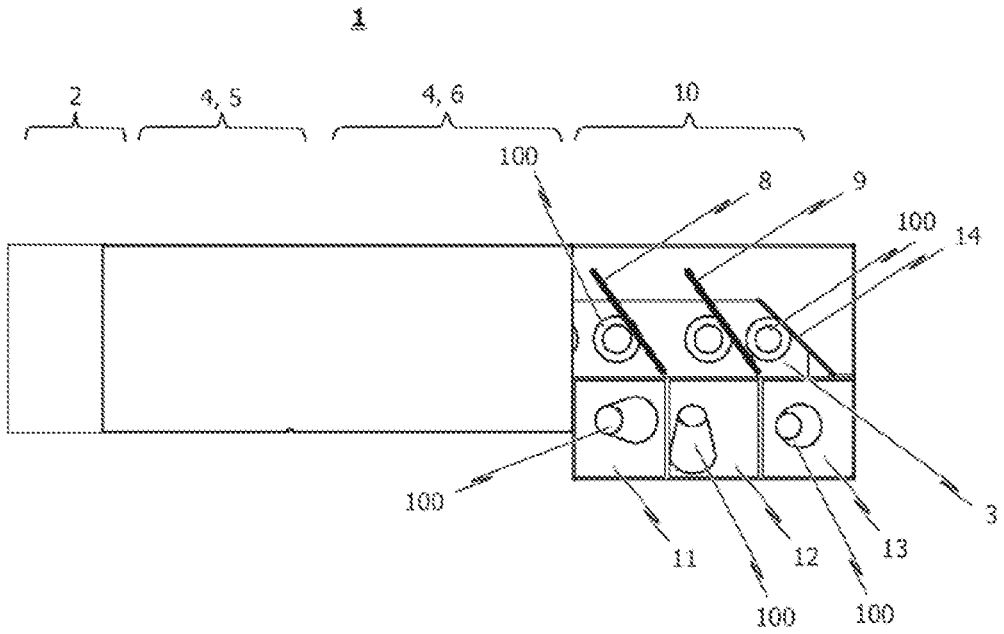
FIG. 8 the embodiment of the inventive dishwasher according to FIG. 5 in a schematic top view.
Figure 9:
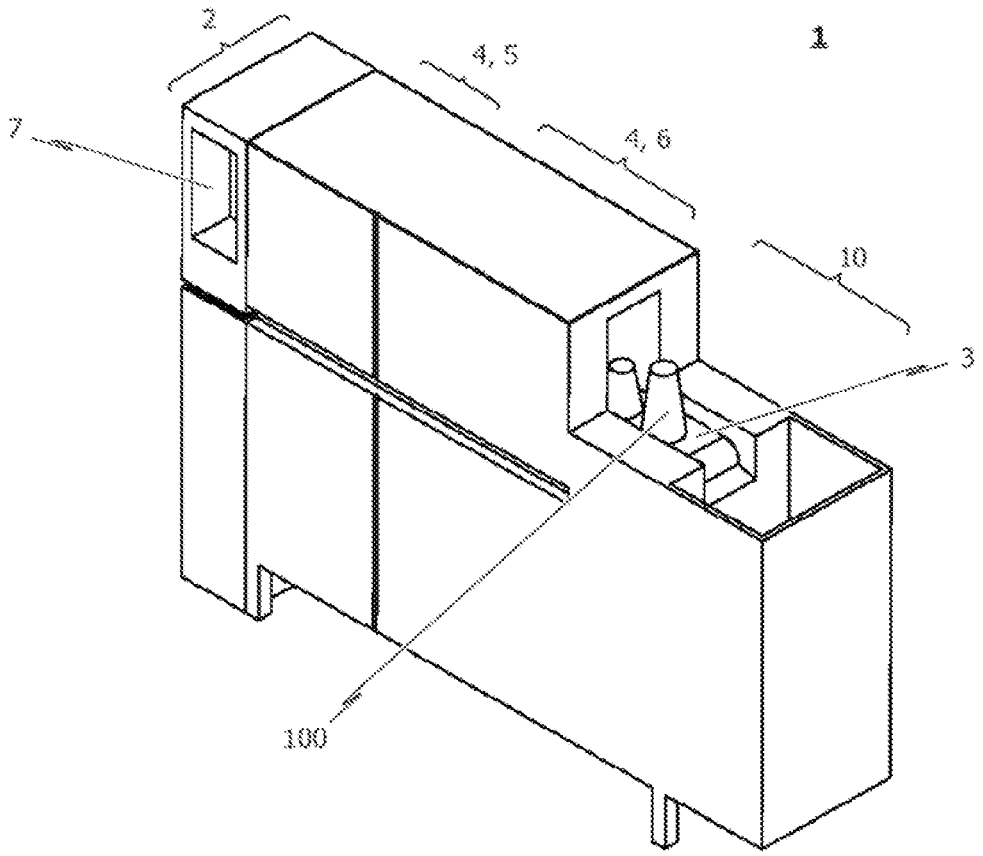
FIG. 9 a further embodiment of the inventive dishwasher in a schematic isometric side view.
Figure 10:
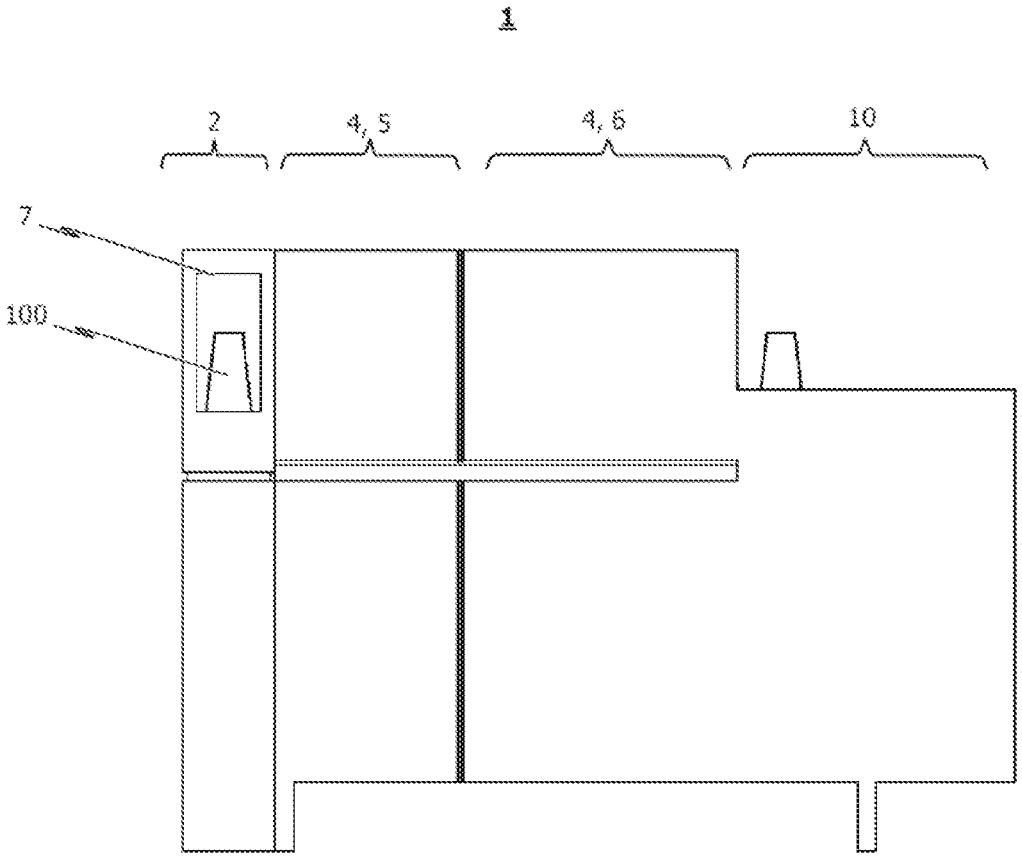
FIG. 10 the embodiment of the inventive dishwasher according to FIG. 9 in a schematic side view.
Figure 11:
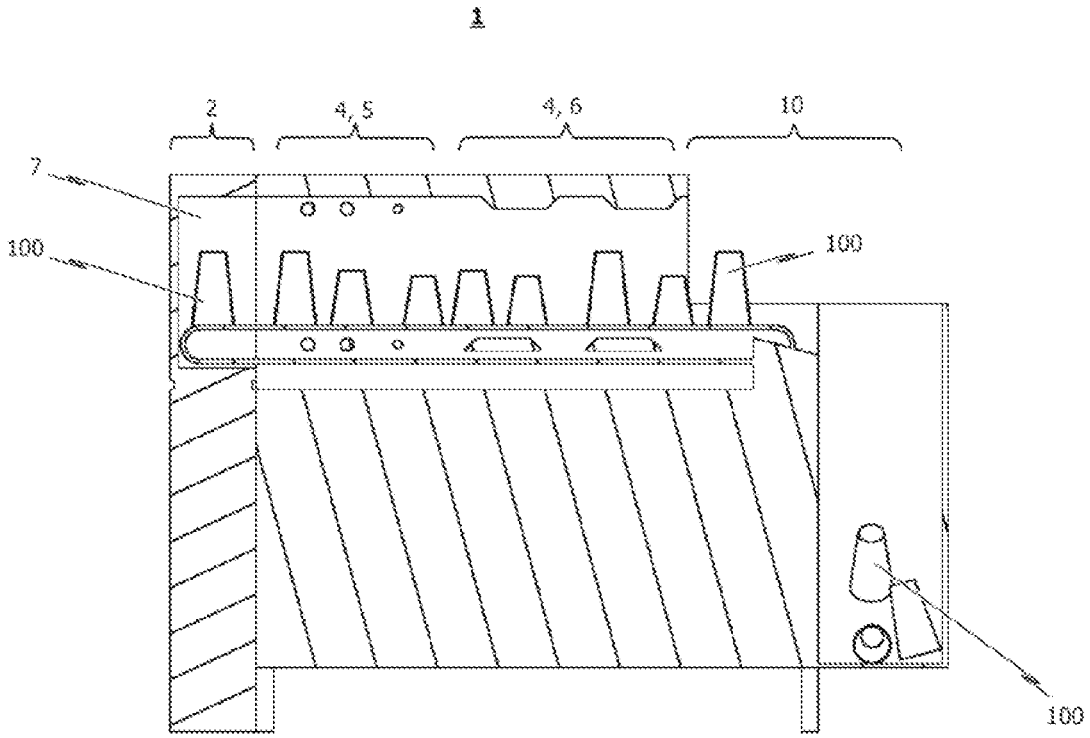
FIG. 11 the embodiment of the inventive dishwasher according to FIG. 9 in a schematic, partially cross-sectional side view; and in FIG. 12 a top view onto the embodiment of the inventive dishwasher according to FIG. 9.
Figure 12:
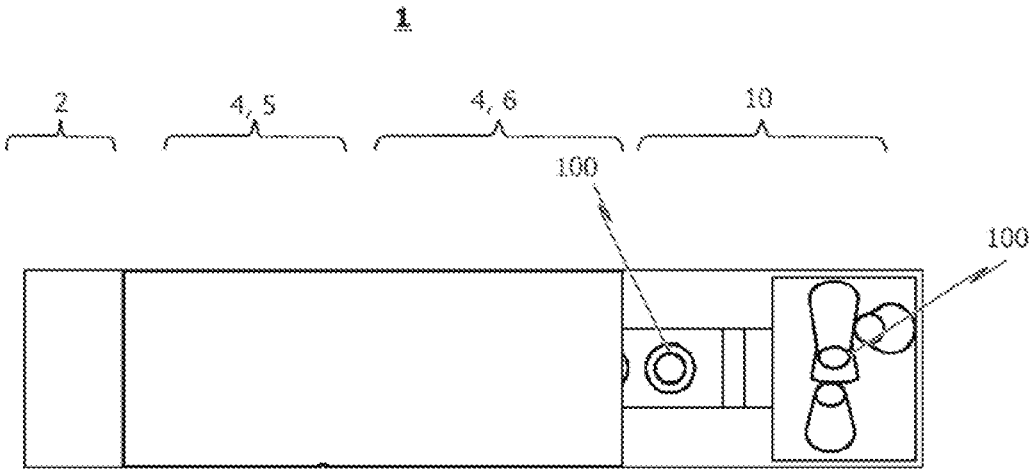

More compact designs of the dishwasher 1 are shown in FIG. 3 and FIG. 4. Here, the length of the dishwasher 1 (with the exception of the input or insertion region 2 adapted as the return machine) is 1.2 and 1.5 m, respectively, at a height of about 1.3 m and a width of about 0.4 m.

The compact design of the body of the dishwasher 1 allows integrating the latter in a coffee shop or fast-food restaurant.

Further exemplary embodiments of the inventive dishwasher 1 are described below with reference to the illustrations in FIG. 5 to FIG. 8 and with reference to the illustrations in FIG. 9 to FIG. 12.

The further embodiments of the inventive dishwasher 1 are adapted in particular for use in a coffee shop and/or a fast-food restaurant. In this context, for example, it is conceivable that the dishwashers 1 can be used to clean the washware 100 served by the coffee shop or the fast-food restaurant after its use.

The dishwasher 1 is in particular associated with an input or insertion region 2 adapted as a return device, and preferably in particular adapted as a return machine for reusable washware items.

The dishwasher 1 further comprises a transport device 3 for transporting the washware 100 from the input or insertion region 2 to a treatment area 4 of the dishwasher 1 and from there to an output or removal region 10 of the dishwasher 1.

The treatment area 4 of the dishwasher 1 comprises a washing and rinsing system 5 for washing and rinsing the washware. Optionally, the dishwasher 1 can also have a downstream drying system 6—when viewed in the transport direction of the washware—for drying the rinsed washware.

In the embodiments of the inventive dishwasher 1 shown in FIG. 5 to FIG. 12, the input or insertion region 2 of the dishwasher 1 is directly connected to the treatment area 4 of the dishwasher 1.

Alternatively, however, it is also conceivable that the input or insertion region 2 assigned to the dishwasher 1 and in particular adapted as a return device, and preferably in particular adapted as a return machine for reusable washware items, is arranged separately from an inlet tunnel of the dishwasher 1 leading to the treatment area 4 of the dishwasher 1.

Such an alternative embodiment allows the input or insertion region 2 of the dishwasher 1 in particular adapted as a return device and preferably in particular adapted as a return machine for reusable washware items to be used in the coffee shop or a fast-food restaurant itself such that customers of the coffee shop or fast-food restaurant can transfer the used, reusable washware items to the dishwasher 1. In this alternative embodiment, the actual treatment area 4 of the dishwasher 1 can be located elsewhere outside the coffee shop or fast-food restaurant.

The alternative embodiment is thus in particular suitable for so-called drive-through shops.

Although not shown in FIG. 5 to FIG. 12, the input or insertion region 2 of the dishwasher 1 associated with the dishwasher 1, and in particular adapted as a return device and preferably in particular adapted as a return machine for reusable washware items, may comprise a refund device.

Further, it is conceivable that the input or insertion region 2 associated with the dishwasher 1 and in particular adapted as a return device and preferably in particular adapted as a return machine for reusable washware items, comprises a user interface and an identification device for washware items that cooperates with a data processing device and a data storage device, wherein the identification device can in particular comprise an optical detection system, and/or wherein the identification device can be adapted for barcode recognition, RFID detection, three-dimensional surface analysis, 3D-Matching, logo recognition, OCR detection and/or color detection.

The illustrations in FIG. 5 to FIG. 12 further show that the input or insertion region 2 of the dishwasher 1 associated with the dishwasher 1 and in particular adapted as a return device and preferably in particular adapted as a return machine for reusable washware items, comprises an access opening 7 for accepting washware items. However, it is of course also conceivable for the dishwasher 1 to have a plurality of access openings 7, in particular arranged next to one another, for accepting washware items.

It is further conceivable that the at least one access opening 7 of the dishwasher 1 is preferably associated with a closing element adjustable between an open position and a closed position.

Although not shown in the drawings, it is expedient according to design variants of the inventive dishwasher 1 that the input or insertion region 2 associated with the dishwasher 1 and in particular adapted as a return device and preferably in particular adapted as a return machine for reusable washware items has an access opening 7 with an outline corresponding to the washware item to specify an orientation of the washware item in particular when feeding the washware item manually into the input or insertion region 2 of the dishwasher 1.

The further embodiments of the inventive dishwasher 1 shown in FIG. 5 to FIG. 12 comprise a transport device 3 with a single transport lane, although it is of course also conceivable that multiple transport lanes running in parallel are used.

At the input or insertion region 2 of the dishwasher 1, the washware 100 (here: beverage cup) to be cleaned is placed on the transport lane, preferably in a predetermined orientation of the washware item, in particular in an upside-down orientation. The washware item thus accepted by the transport lane of the transport device 3 is then transported through the treatment zones or the treatment area 4 of the conveyor dishwasher 1. The embodiments of the inventive dishwasher 1 shown in FIG. 5 to FIG. 12 represent a washing and rinsing system 5 as well as a downstream drying system 6. Such a drying system 6 may be omitted.

After the washware items have passed through the treatment zones of the conveyor dishwasher 1, they are fed to an output or removal region 10 of the dishwasher 1 using the at least one transport lane of the transport device 3.

In the design variant of the inventive dishwasher 1 shown in FIG. 5 to FIG. 8, the (cleaned) washware items are automatically sorted according to their size in the output or removal region 10 of the dishwasher 1.

In detail, a first wiper device 8 is provided for this purpose in the output or removal region 10 of the dishwasher 1, said wiper device 8 being adapted to unload from the transport lane of the transport device 3 preferably exclusively the particular washware 100 having a predetermined or specifiable first minimum size/minimum height.

For this purpose, the first wiper device 8 comprises a guide, which, with reference to a plane that extends at least in the output or removal region 10, is vertically spaced such that during transport with the transport lane through the output or removal region 10 any washware 100 having the first predetermined or specifiable minimum size/minimum height bumps against the guide of the first wiper device 8, but not the washware 100 having a smaller size/height.

Said washware 100 having a lesser height/size is transported further by the conveyor 3, namely to a second wiper device 9, which also has a guide that is vertically spaced with reference to the plane in which the transport lane extends at least in the output or removal region 10 of the dishwasher 1, such that during transport with the transport lane through the output or removal region 10 of the dishwasher 1, any washware items having the second predetermined size/height, which is less than the first predetermined or specifiable size/height, bumps against guide of the second wiper device 9 and is redirected from the transport direction determined by the transport belt.

In particular, this washware 100 is then stacked or collected accordingly in a dedicated collection area 11, 12.

After passing the first and second wiper devices 8, 9, all further washware 100 is then redirected with a lateral guide 14 into a third dedicated area 13.

The guides of the wiper devices are preferably variably adjustable in vertical direction to adjust the dishwasher 1 for different types of washware.

The invention is not limited to the embodiments shown in the drawings, but rather results when all of the features disclosed herein are considered together.

LIST OF REFERENCE NUMERALS

1 Dishwasher
2 Input/insertion region
3 Transport device
4 Treatment area
5 Washing and rinsing system
6 Drying system
7 Access opening
8 First wiper device
9 Second wiper device
10 Output or removal region
11 First dedicated area
12 Second dedicated area
13 Third dedicated area
14 Guide
100 Washware item

The invention claimed is:

1. A dishwasher, for a coffee shop and/or for a fast-food restaurant, for cleaning washware, wherein the dishwasher includes an input or insertion region for receiving reusable washware items, and wherein the dishwasher comprises a transport device for transporting the washware from the input or insertion region to a treatment region of the dishwasher and from there to an output or removal region of the dishwasher, wherein the treatment region of the dishwasher comprises a washing and rinsing system for washing and rinsing the washware and optionally, a drying system for drying the rinsed washware, said drying system being located downstream when viewed in the transport direction of the washware;

wherein the transport device is configured to transport the washware in a linear transport direction from the insertion region, located at one end of dishwasher, to the output or removal region, located toward an opposite end of the dishwasher;

wherein the input or insertion region comprises at least one access opening for receiving washware items, wherein the at least one access opening is arranged as a side opening through which washware items are inserted in a direction that is transverse to the linear transport direction;

wherein the output or removal region includes a first wiper that is vertically spaced above a transport plane of the transport device in the output or removal region for directing washware items laterally off of the transport device to a first collection area, and a second wiper that is downstream of the first wiper and is vertically spaced above the transport plane for directing washware items laterally off of the transport device into a second collection area, wherein a spacing of the first wiper above the transport plane is greater than a spacing of the second wiper above the transport plane, such that certain washware items contact the first wiper during transport and are directed into the first collection area and certain washware items pass under the first wiper and contact the second wiper and are directed into the second collection area.

2. The dishwasher according to claim 1, wherein the input or insertion region is arranged separately from an inlet tunnel of the dishwasher leading to the treatment area of the dishwasher.

3. The dishwasher according to claim 1, wherein the input or insertion region comprises a user interface and an identification device for washware items that cooperates with a data processing device and a data storage device, wherein the identification device comprises an optical detection system and/or wherein the identification device is adapted for barcode recognition, RFID detection, three-dimensional surface analysis, 3D-Matching, logo recognition, OCR detection and/or color detection.

4. The dishwasher according to claim 1, wherein the access opening is associated with a closing element adjustable between an open position and a closed position.

5. The dishwasher according to claim 1, wherein the at least one access opening includes an outline corresponding to the washware item to be cleaned to specify an orientation of the washware items when manually placing the washware item into the input or insertion region.

6. The dishwasher according to claim 1, wherein the input or insertion region comprises a device for sorting the washware items according to their size and/or type, wherein the washware items, sorted by size and/or type, are automatically fed to a corresponding transport lane of the transport device.

7. The dishwasher according to claim 1, wherein the transport device comprises at least two transport lanes that run in parallel, which are adapted to transport at least two washware items in parallel through the dishwasher, wherein each of the at least two transport lanes is adapted to exclusively accept washware items of a pre-determined size and/or type assigned to the respective transport lane.

8. The dishwasher according to claim 1, wherein the transport device comprises at least one transport lane, wherein the at least one transport lane has dedicated acceptance areas adjacent to each other, wherein each acceptance area is adapted to accept precisely one washware item, wherein the at least one transport lane is associated with a hold-down device adapted to secure the washware item in a vertical direction.

9. The dishwasher according to claim 8, wherein the hold-down device associated with the at least one transport lane comprises at least one guide that travels together with the transport lane and extends above the washware item.

10. The dishwasher according to claim 8, wherein the at least one transport lane comprises at least one finger area projecting perpendicularly or transversely to the transport direction of the transport lane, and is adapted to at least sectionally accept a washware item.

11. The dishwasher according to claim 1, wherein when viewed in the transport direction of the washware, a stacking device for automatically stacking the washware items is provided downstream of the drying system at the output or removal region of the dishwasher.

12. The dishwasher according to claim 11, wherein the stacking device is adapted to stack the washware items dried in the drying system-sorted by the size and/or type of the washware items—in a corresponding stack of washware.

13. The dishwasher according to claim 1, wherein the dishwasher comprises a device for automatically determining the cleanliness of the washware cleaned in the washing and rinsing system.

14. The dishwasher according to claim 1, wherein the dishwasher—when viewed in the transport direction of the washware—comprises a storage area upstream of the treatment area as interim storage for a pre-determined or specifiable number of washware items to be cleaned; and/or wherein the output or removal region of the dishwasher is adapted as a storage area for the interim storage of a pre-determined or specifiable number of washware items.

15. The dishwasher according to claim 1, wherein the dishwasher comprises a control device adapted to control the transport device such that the transport device discontinuously transports the washware to be cleaned through the treatment area to the output or removal region of the dishwasher; or wherein the dishwasher comprises a control device adapted to control the transport device such that the transport device transports the washware to be cleaned continuously, and at a predetermined or specifiable transport speed, through the washing and rinsing system and the drying system.

16. The dishwasher according to claim 1, wherein the dishwasher comprises a control device for controlling the transport device and/or for controlling controllable components associated with the washing and rinsing system and/or the drying system, wherein the control device is adapted to control the transport device and, if necessary, controllable components associated with the washing and rinsing system and/or the drying system as a function of a presence or absence, or as a function of a number, of washware items, in the input or insertion region, and/or in the output or removal region of the dishwasher.

17. The dishwasher according to claim 1, wherein the dishwasher has a length of about 1 to 3 meters, a height of about 1 to 1.75 meters and a width of about 0.3 to 1 meter.

18. A dishwasher, for a coffee shop and/or for a fast-food restaurant, for cleaning washware, wherein the dishwasher includes an input or insertion region for receiving reusable washware items, and wherein the dishwasher comprises a transport device for transporting the washware from the input or insertion region to a treatment region of the dishwasher and from there to an output or removal region of the dishwasher, wherein the treatment region of the dishwasher comprises a washing and rinsing system for washing and rinsing the washware and optionally, a drying system for drying the rinsed washware, said drying system being located downstream when viewed in the transport direction of the washware;

wherein the input or insertion region has a first access opening for accepting washware items of a first type and/or size and/or shape and at least one second access opening for accepting washware items of a second type and/or size and/or shape, wherein each access opening is associated with its own transport lane adapted to transport the washware item placed into the corresponding access opening through the treatment zone-region of dishwasher.

19. The dishwasher according to claim 18, wherein each access opening is associated with its own closing element adjustable between an open position and a closed position.

20. The dishwasher according to claim 18, wherein the dishwasher comprises a washware detection system adapted to detect the type, size and/or shape of a washware item to be placed into the dishwasher, wherein the dishwasher is adapted to control a closing element of one of the access openings depending on the detected size and/or shape of the washware item such that the closing element transitions from its closed position to its open position and allows the washware item to enter through the corresponding access opening, so as to assure that the washware item enters through a correct one of the access openings.

21. The dishwasher according to claim 18, wherein the dishwasher comprises an interface by which the type, size and/or shape of a washware item to be placed into the dishwasher can be selected and/or entered automatically, wherein the dishwasher is adapted to control a closing element of one of the access openings depending on the selected and/or entered type, size and/or shape of the washware item such that said access opening transitions from its closed position to its open position and allows the washware item to be placed into the corresponding access opening, so as to assure that the washware item enters through a correct one of the access openings.

22. The dishwasher according to claim 21, wherein the dishwasher comprises an item load detector adapted to detect that a washware item was placed into one of the access openings, and which is further adapted to control the closing element associated with the respective access opening upon or after detecting that a washware item was placed into one of the access openings such that it transitions from its open position to its closed position.

* * * * *